United States Patent [19]

Cunningham

[11] 4,214,150

[45] Jul. 22, 1980

[54] ELECTRIC HEATING ELEMENTS

[75] Inventor: Donald M. Cunningham, Pittsburgh, Pa.

[73] Assignee: Emerson Electric Co., St. Louis, Mo.

[21] Appl. No.: 904,556

[22] Filed: May 10, 1978

[51] Int. Cl.[2] ..... H05B 1/02; H05B 3/68

[52] U.S. Cl. ..... 219/452; 200/85 A; 219/518

[58] Field of Search ..... 219/518, 452, 467; 200/85 R, 85 A

[56] References Cited

U.S. PATENT DOCUMENTS

| | | | |
|---|---|---|---|
| 1,637,155 | 7/1927 | Marsden | 219/518 |
| 2,155,425 | 4/1939 | Mere | 219/518 |
| 2,919,337 | 12/1959 | Brosseau et al. | 219/452 |
| 2,988,625 | 6/1961 | Hart | 219/452 |
| 3,042,783 | 7/1962 | Mertler | 219/518 |
| 3,134,007 | 5/1964 | Niblo | 219/518 |
| 3,931,495 | 1/1976 | Dzaack et al. | 219/467 |

FOREIGN PATENT DOCUMENTS

| | | | |
|---|---|---|---|
| 595145 | 3/1934 | Fed. Rep. of Germany | 219/452 |
| 972896 | 2/1951 | France | 219/452 |

*Primary Examiner*—B. A. Reynolds
*Assistant Examiner*—Bernard Roskoski
*Attorney, Agent, or Firm*—Michael Williams

[57] ABSTRACT

An electric heating element for the top panel of a cooking stove, having terminals adapted to be plugged into a terminal block carried by the stove panel, and embodying means for automatically interrupting current flow to the heating element when a cooking utensil is removed therefrom. The means for automatically interrupting the current flow comprises a weight responsive switch with at least one contact in the terminal block.

6 Claims, 5 Drawing Figures

ELECTRIC HEATING ELEMENTS

BACKGROUND AND SUMMARY

The prior art, as shown in U.S. Pat. No. 3,586,824, issued June 22, 1971, to Edward A. Barney, includes a heating appliance in which a plate is adapted to support a cooking utensil and is moved downwardly toward a heating element by weight of the utensil. Switching means are provided whereby the heating element is energized upon downward movement of the plate and deenergized upon upward movement of the plate. The Barney construction has some disadvantages in that the plate is interposed between the cooking utensil and the heating element and therefore prevents direct conduction of heat from the element to the utensil.

Further, most of the surface units now produced are of the plug-in type, wherein the terminals of the heating element have plug-in connection with terminals within a terminal block, so that the heating element and customary drip pan may be easily removed from operative position on the stove top for cleaning purposes. Prior art, such as U.S. Pat. No. 3,042,783, issued July 3, 1962, to C. S. Mertler, shows a plug-in surface unit, but flow of electrical current to the heating element is under control of a thermal sensing unit and in such art the current flow to the heating element is not automatically interrupted when a cooking utensil is removed therefrom.

It is a known fact that considerable electrical energy is wasted by reason of the fact that the housewife does not immediately turn the control switch to "off" position after she removes a cooking utensil from the heating element, or forgets to turn the switch "off" until some time later. My invention provides the benefit of plug-in surface units and embodies means to immediately interrupt flow of electrical current to the heating element when the utensil is removed therefrom.

DESCRIPTION OF THE DRAWINGS

In the drawings accompanying this specification and forming a part of this application, there is shown, for purposes of illustration, an embodiment which my invention may assume, and in these drawings.

DESCRIPTION OF THE PREFERRED EMBODIMENT

Figure 2:
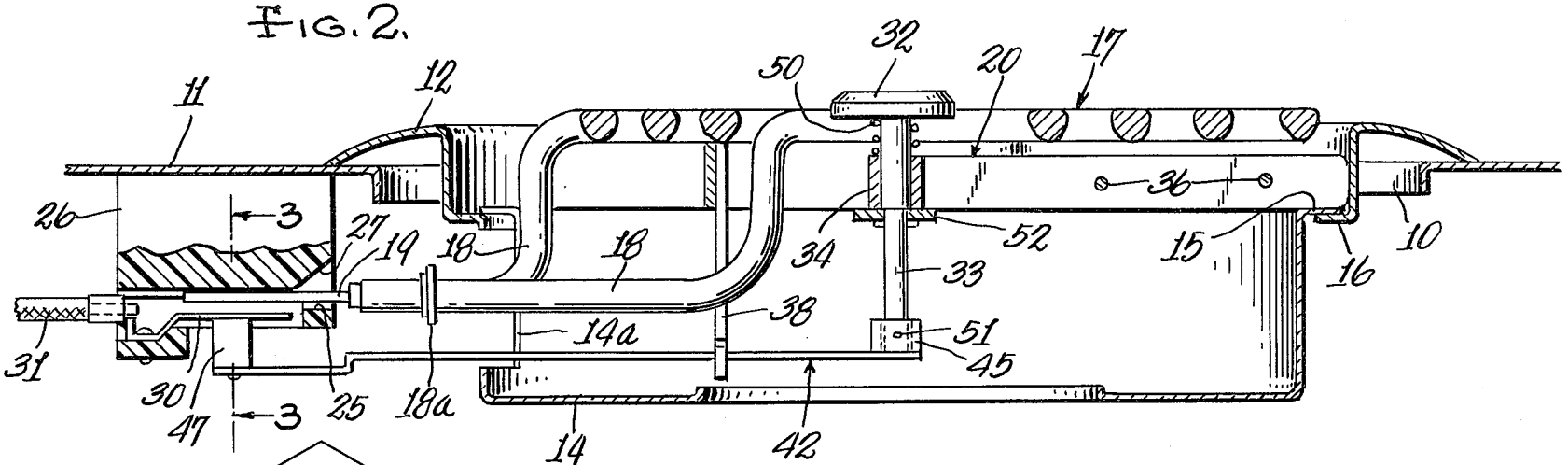
FIG. 2 is an enlarged, fragmentary sectional view corresponding generally to the line 2—2 of FIG. 1.
Figure 3:
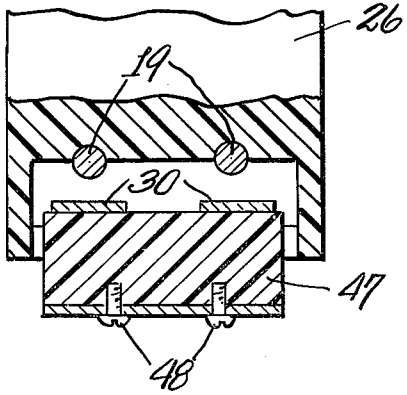
FIG. 3 is an enlarged, transverse sectional view corresponding generally to the line 3—3 of FIG. 2.
Figure 4:
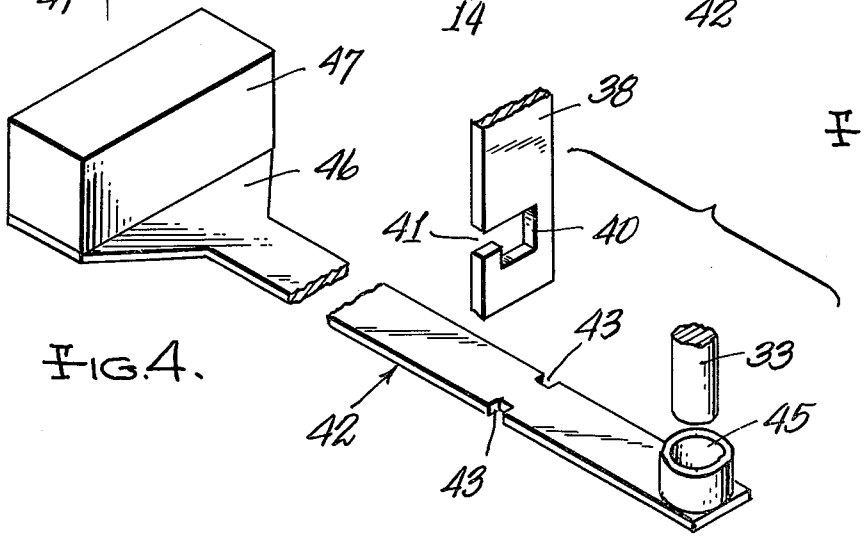
FIG. 4 is an enlarged, separated, fragmentary perspective view of parts utilized in the construction shown in FIG. 2.

My invention incorporates a surface unit of conventional design and is adapted to be supported within an opening 10 in a stove top panel 11. The usual trim ring 12 has its outer periphery engaging the panel 11, as seen in FIG. 2. A conventional drip pan 14 has an upper peripheral ledge 15 supported on an inturned ledge 16 of the trim ring.

The heating element 17 is of usual construction and comprises a metal sheathed element which is wound to flat, spiral formation and has terminal portions 18—18 extending downwardly and outwardly of the spiral, and through a side opening **14*a* in the drip pan as seen in FIG. 2. A metal plate 18*a* is connected across the terminal portions 18—18 to maintain lateral spacing therebetween. Terminal pins 19—19 extend outwardly of the extremities of respective terminal portions and are adapted to connect the heating element 17** to a source of electrical current. The terminal pins may take any suitable form and in the disclosed embodiment are simply round metal pins which are inexpensive and satisfactory for the presently intended use.

Figure 1:
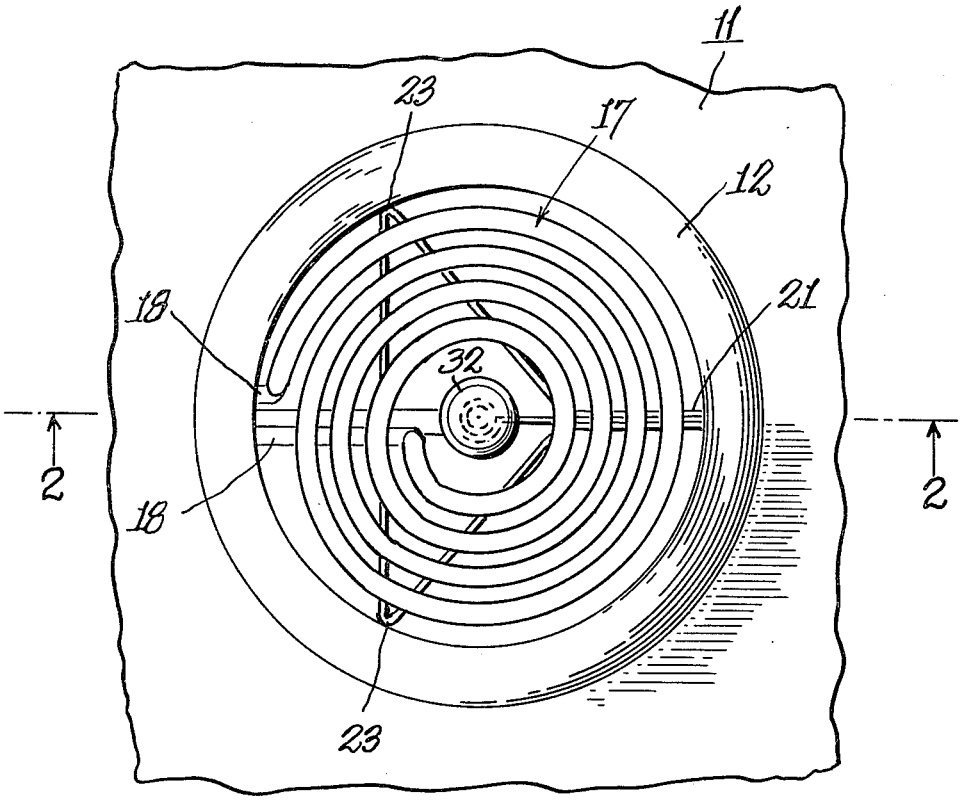
FIG. 1 is a fragmentary top plan view of a stove panel, showing a surface unit in operative position.
Figure 5:
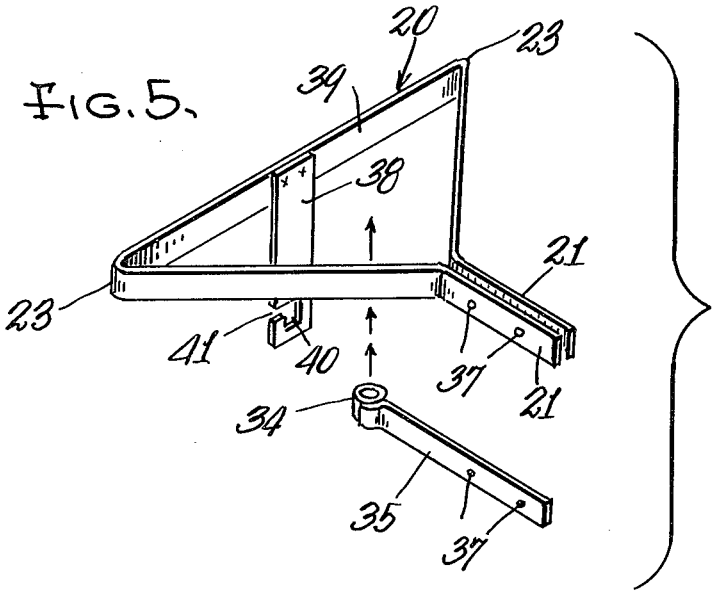
FIG. 5 is a separated, perspective view of further parts.

The flat, spiralled heating element is supported on a spider which may take any suitable form. For purposes of illustration, the spider 20 herein shown comprises a flat metal strip bent to a triangular shape, as seen in FIG. 5, with flat portions 21—21 extending from the ends of legs 22—22. Normally the portions 21—21 are held together by rivets or welding and the heating element is secured in any suitable manner to the spider. As seen in FIGS. 1 and 2, the spider is disposed within the trim ring in edgewise fashion, and corners 23—23 and the ends of flat portions 21—21 rest on the peripheral ledge 15 of the drip pan 14.

All of the foregoing represents conventional construction which is well adapted for incorporation with my invention now to be described. As seen in FIG. 2, the terminal pins may be projected through respective openings 25 formed in a terminal block 26 which is of insulating material. The block may be secured to the undersurface of the stove panel 11 in any suitable manner. The openings 25 are oversize with respect to the respective terminal pins 19 so that the latter may be projected through the openings with ease but are thereby aligned with other parts carried by the terminal block. Each opening may have an angled entranceway 27 so that the heating element may be tilted for assembly to or removal from its normal operating position shown in FIG. 2.

A pair of spring contact blades 30—30 are rigidly held in spaced parallel relation within the cavity of the terminal block 26, and each blade is electrically connected to a conductor 31 (only one visible in FIG. 2), the conductors being adapted for connection to a source of electrical energy. At least one of the blades 30—30 is adapted to be moved to engagement with a respective terminal pin to complete an electrical circuit to the heating element 17 and in the disclosed embodiment both blades are so moved for safety purposes.

In the disclosed embodiment, a circular head 32 is disposed for vertical movement within the center opening of the flat, spirallel heating portion of the element 17, the head having a depending stem 33 which is slidable within a sleeve 34. The sleeve may be carried by the spider 20 and, as seen in FIG. 5 may be welded to a curved end of a leg 35. The leg 35 is disposed between the flat portions 21—21 of the spider and held by rivets 36 which extend through aligned openings 37. A metal strap 38 is welded to the center portion of leg 39 of the spider, and extends downwardly therefrom. Near its lower end, the strap 38 has an opening 40 with a restricted entrance-way 41.

A lever 42 is pivoted intermediate its ends on the strap 38. For this purpose, the lever has a pair of aligned side notches 43—43 and the lever is moved to assembled position by moving it edgewise through the restricted entranceway 41 so that the part between the notches 43 may drop to the lower edge of the opening 40 in the strap 38, whereby the lever 42 is confined against longitudinal shifting but is free to pivot a limited amount.

A cup 45 is fixed to the inner end of the lever 42 and loosely receives the lower end of the stem 33. The opposite end of the lever is widened, as seen at 46, to support a block 47 of insulating material, connected to the end 46 in any suitable manner, as by screws 48. The block 47 is wide enough to span both of the contact strips 30—30 so that when the lever 42 is pivoted to move the block 47 upwardly, the contact strips 30—30 are moved into abutment with respective terminal pins 19. The lever 42 is normally weighted by the block 47 to assume the position shown in FIG. 2 wherein the contact strips 30—30 are out of engagement when the head 32 is free of engagement with a cooking vessel. If desired, a coil spring 50 may be interposed between the head 32 and the sleeve 34 to positively insure that the lever will assume the position shown in FIG. 2 when a cooking vessel is removed from the heating element. In some cases, it may be found desirable to connect the lower end of the stem 33 to the cup by a pin connection 51. In order to limit upward movement of the head 32, especially when the spring 50 is added, a washer 52 may be connected to the stem 33, for abutment with the lower end of the sleeve 34.

I claim:

1. An electric heating element of the type comprising a sheathed unit having a flat, spiralled active heating portion with a pair of terminal portions extending downwardly from and laterally of said heating portion, each terminal portion having a rigid terminal pin extending outwardly of the sheated end, said flat heating portion being adapted to directly support a cooking vessel to heat the latter and its contents, the improvement comprising support means, said sheathed with being removable mounted on said support means:

a pair of contact members carried by said support means and, each adapted for connection to an electric power conductor, said contact members being adapted for electric contact with respective terminal pins to provide electrical current to said active heating portion to heat the same, vertically movable means normally disposed in an upper position above the plane of said flat heating portion when no cooking vessel is supported on said active heating portion, but movable downwardly to a lower position at least within said plane by the weight of a cooking vessel placed on said active heating portion, and means providing for movement of at least one of said contact members out of electrical contact with its respective terminal pin in response to movement of said vertically movable means to its upper position.

2. The construction according to claim 1 wherein said contact members are disposed within the cavity of a dielectric terminal block, and wherein said sheathed unit is of the plug-in type with said terminal pins inserted into said terminal block cavity in associated relation with said contact members when said heating element is in a normal operating position to support a cooking vessel.

3. The construction according to claim 1 wherein each of said contact members is a spring blade normally biased out of electrical contact with the related terminal pins when said vertically movable means is in its upper position.

4. An electric heating element of the type comprising a sheathed unit having a flat, spiralled active heating portion with a pair of terminal portions extending downwardly from and laterally of said heating portion, each terminal portion having a rigid terminal pin extending outwardly of its end, the winding of said spiralled active heating portion providing a central opening in the same, and said flat heating portion being adapted for support within an opening of a stove panel and adapted to directly support a cooking vessel, the improvement comprising:

a dielectric terminal block supported by said stove panel and extending downwardly from an undersurface of the latter, said terminal block having a cavity and said terminal pins being disposed within said cavity in spaced side-by-side relation, a pair of spaced spring blade contact members fixed within said cavity in adjoining relation with respect to respective terminal pins but spring biased out of electrical contact with the same, each contact member being adapted for for electrical connection to a power conductor, vertically movable means including a head portion movable through the central opening in said spiralled active heating portion, said head portion being normally disposed in an upper position above the plane of said flat heating portion when no cooking vessel is supported on the latter, but movable downwardly to a lower position at least within said plane by the weight of a cooking vessel, and means transmitting movement of said vertically movable means to said contact members whereby when said head portion is in its upper position, said contact members are spring biased out of electrical contact with respective terminal pins, and when said head portion is in its lower position said contacts are moved against the force of said spring bias and into electrical contact with said terminal pins.

5. The construction according to claim 4 wherein said vertically movable means includes a stem portion depending from said head portion, a lever pivoted intermediate its ends, one end being operatively associated with said stem portion and the other lever end supporting a block of insulating material which is adapted to press against said contact members and move them into electrical contact with respective terminal pins.

6. The construction according to claim 4 wherein said sheathed unit is of the plug-in type with said terminal pins inserted into said terminal block cavity in associated relation with said contact members when said heating element is in a normal operating position to support a cooking vessel.

* * * * *

UNITED STATES PATENT OFFICE
CERTIFICATE OF CORRECTION

PATENT NO. : 4,214,150

DATED : July 22, 1980

INVENTOR(S) : Donald M. Cunningham

It is certified that error appears in the above-identified patent and that said Letters Patent are hereby corrected as shown below:

In claim 1:

Line 6 - "sheated" should be ---sheathed---.

Line 9 - place a comma after "comprising."

Line 9 - cancel "with" and insert ---unit---.

Line 10 - cancel "removable" and insert ---removably---.

Line 12 - remove the comma after "and."

Signed and Sealed this

*Eighteenth* Day of *November 1980*

[SEAL]

*Attest:*

SIDNEY A. DIAMOND

*Attesting Officer*

*Commissioner of Patents and Trademark*